United States Patent [19]

Blehert et al.

[11] Patent Number: 4,819,676

[45] Date of Patent: Apr. 11, 1989

[54] COMBINATION SWEEPING AND SCRUBBING SYSTEM AND METHOD

[75] Inventors: Michael L. Blehert, Crystal; Archie A. Weidner, Minneapolis, both of Minn.

[73] Assignee: Tennant Company, Minneapolis, Minn.

[21] Appl. No.: 819,911

[22] Filed: Jan. 16, 1986

[51] Int. Cl.[4] ..... B08B 5/04

[52] U.S. Cl. ..... 134/21; 134/25.1; 134/25.4; 15/349; 15/352; 15/348; 15/83; 15/320; 15/321; 15/353

[58] Field of Search ..... 15/320, 321, 345, 346, 15/347, 353, 349, 352, 348, 83; 134/18, 25.4, 25.1

[56] References Cited

U.S. PATENT DOCUMENTS

| | | | |
|---|---|---|---|
| 2,862,224 | 12/1958 | Swanson et al. | 15/328 |
| 3,065,490 | 11/1962 | Arones | 15/359 |
| 3,197,798 | 8/1965 | Brown et al. | 15/320 |
| 3,206,787 | 9/1965 | Daniels et al. | 15/320 |
| 3,879,789 | 4/1975 | Kasper | 15/320 |
| 4,041,567 | 8/1977 | Burgoon | 15/320 |
| 4,158,901 | 6/1979 | Wulff et al. | 15/401 |
| 4,317,252 | 3/1982 | Knowlton | 15/320 |
| 4,457,036 | 7/1984 | Carlson et al. | 15/49 R |
| 4,492,002 | 1/1985 | Waldhauser et al. | 15/320 |
| 4,554,700 | 11/1985 | Lyman | 15/323 |
| 4,580,313 | 4/1986 | Blehert | 15/349 |
| 4,595,420 | 6/1986 | Williams et al. | 15/320 |
| 4,615,070 | 10/1986 | Fredrick et al. | 15/349 |
| 4,716,621 | 1/1988 | Zoni | 15/349 |

OTHER PUBLICATIONS

Tennant Company, 186 Sweeper/Scrubber Brochure (Copyright 1987).

Tennant Company bulletin "42nd Power Sweeper", Rev. 1983 (7M).

Tennant Company bulletin "240 Power Sweeper", 5-84 (7.5M):240-].

*Primary Examiner*—H. M. S. Sneed

*Assistant Examiner*—Sharon T. Cohen

*Attorney, Agent, or Firm*—Kinzer, Plyer, Dorn, McEachran & Jambor

[57] ABSTRACT

This invention is concerned with a machine and/or system as well as a method of operation and an assembly whereby a sweeping unit may be quickly converted into a scrubbing unit and vice versa. The system is capable of operation either in a sweeping mode or a scrubbing mode and is also adaptable to include a vacuum wand assembly when the unit is to be operated in its sweeping mode.

23 Claims, 7 Drawing Sheets

Fig. 1.
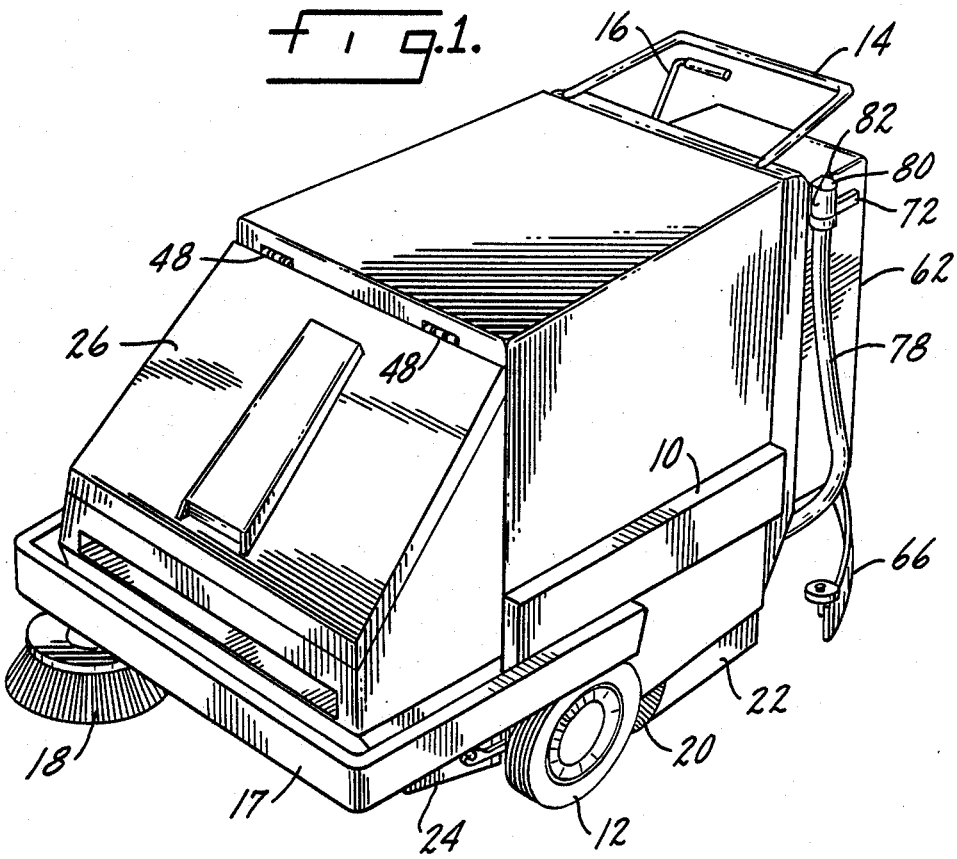
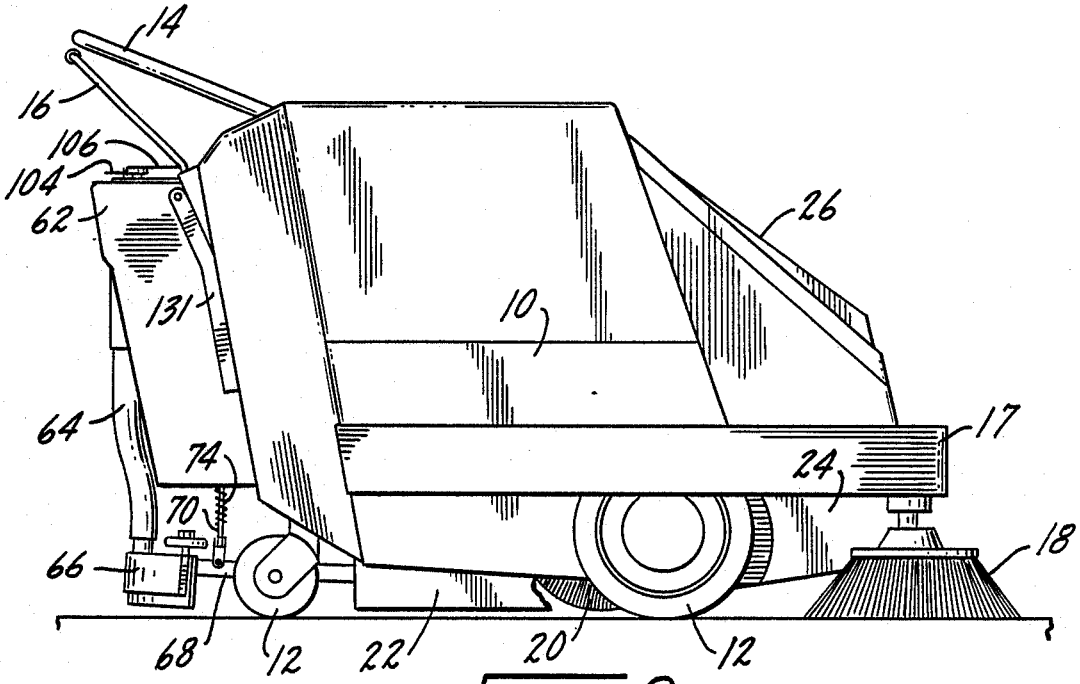
Fig. 2.

Fig. 13.
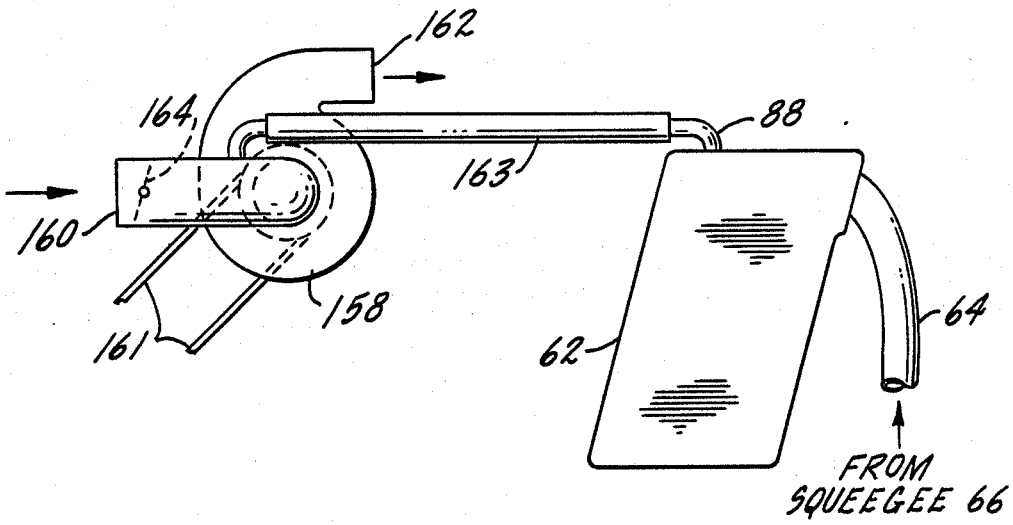
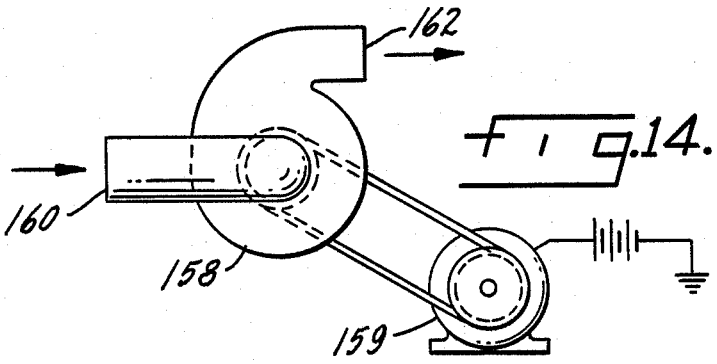
Fig. 14.
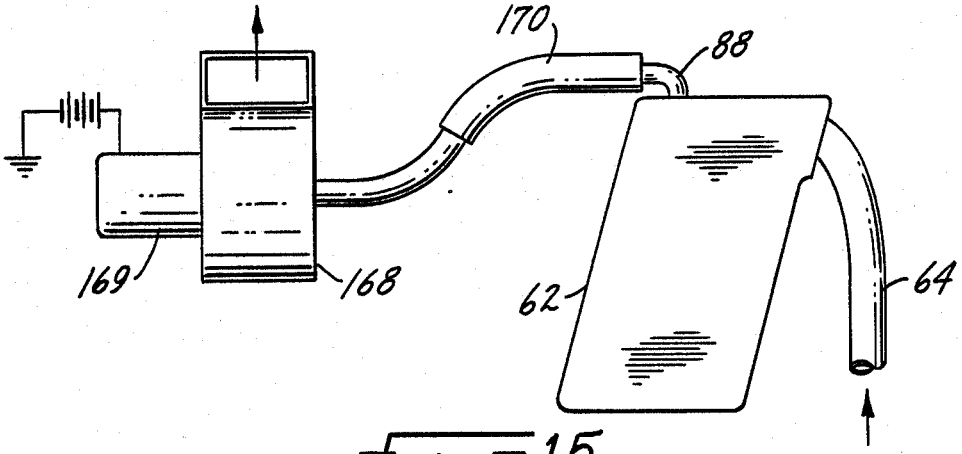
Fig. 15.

COMBINATION SWEEPING AND SCRUBBING SYSTEM AND METHOD

SUMMARY OF THE INVENTION

This invention is concerned with a machine and method for sweeping or scrubbing a surface to be cleaned and is more specifically concerned with a convertible unit which can be easily changed to operate in either a sweeping mode or a scrubbing mode.

A primary object of the invention is a surface cleaning unit which has a more or less permanently mounted recovery tank on the machine which is not used during the sweeping mode.

Another object is a combination sweeping-scrubbing unit which is assembled on a modular basis.

Another object is a unit of the above type which has a debris hopper and clean solution tank which are interchangeable on the front of the unit.

Another object is a machine of the above type in which the interchangeable clean solution tank has a spreader bar and pull-out debris tray which are also removable.

Another object is a unit of the above type which has a superior squeegee vacuum suction.

Another object is a machine of the above type with fewer parts than previous machines.

Another object is a machine of the above type in which the scrubber attachment is light enough in that it can be handled by hand by one man and does not require a dolly.

Another object is a unit of the above type which has reduced changeover time.

Another object is a system of the above type that, when in its sweeping mode, can be used to clean off aisle areas.

Another object is a modular system which has a vacuum wand arrangement that is convenient and easily accessible for cleaning off aisle areas.

Other objects will appear from time to time in the ensuing specification and drawings.

BRIEF DESCRIPTION OF THE DRAWINGS

FIG. 1 is a perspective view from the front left side of the unit;

FIG. 2 is a right side view of the machine in FIG. 1;

FIG. 13 is a schematic of a variant; and

FIGS. 14 and 15 are of a further variant.

DETAILED DESCRIPTION OF THE PREFERRED EMBODIMENT

Figure 4:
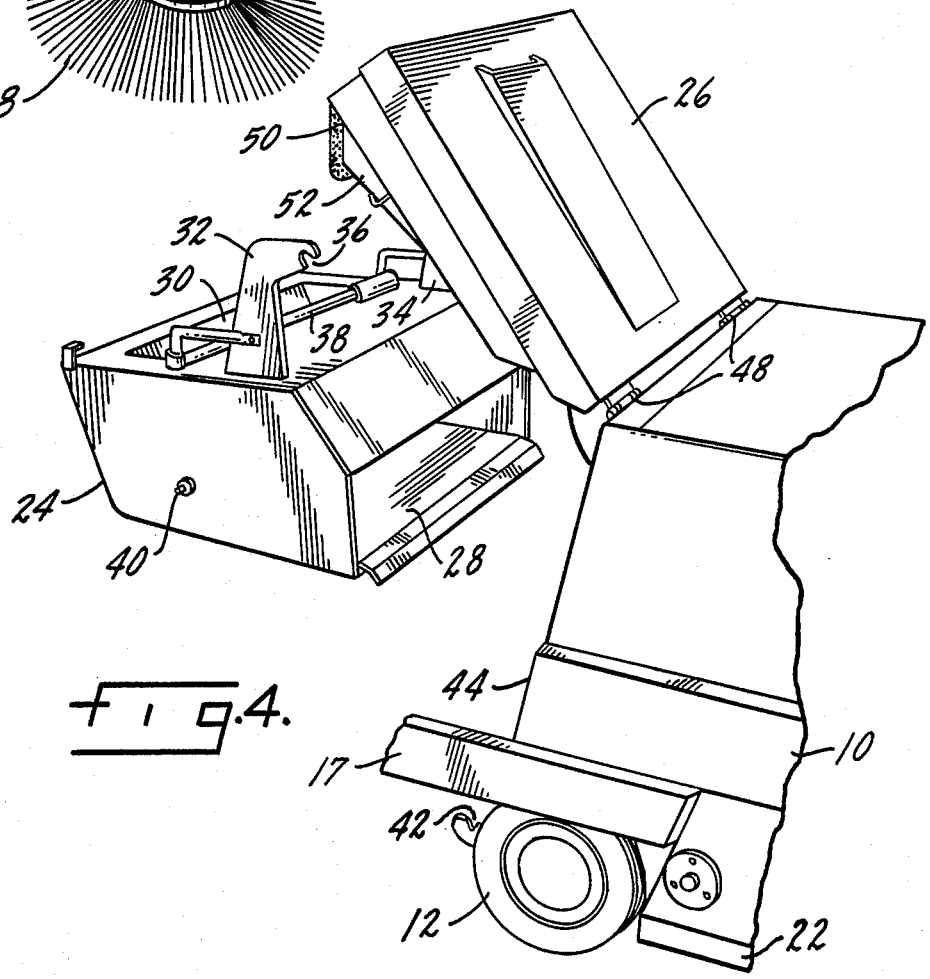
FIG. 4 is a perspective of the other side of the machine with the filter housing pivoted up and the debris hopper lifted out of its front or supported position.

The machine is intended to function optionally as a sweeper or a scrubber. The basic machine has a frame or body portion 10 supported on a plurality of wheels 12. The unit may have suitable controls such as a steering bar 14 and a shifting lever 16 and a full wrapper around bumper 17 in front. A suitable side or gutter brush 18 may be disposed at the forward portion of the machine. The machine includes a rotatably driven cylindrical brush 20 which may be in a suitable dust housing 22 which minimizes dust around the machine when in the sweeping mode. The machine includes a debris hopper 24 removably mounted in the forward portion thereof under a filter housing 26. As shown in FIG. 4, the debris hopper has a rear opening 28 opposite the forward throw cylindrical brush when the hopper is in its operative position so that debris will be collected in the hopper. The upper or top wall of the hopper has an opening 30 and a pair of upwardly extending arms 32 and 34, each of which may have a rearwardly opening slot 36 which is a part of the upper mounting of the hopper in the body or frame of the machine. The hopper may have a lever or bar 38 pivoted thereon to aid in dumping the debris hopper when it is in its operative position.

Each side of the hopper may have a stub shaft or trunion 40 which serve to support the hopper in a removable manner on forwarding extending arms 42, one on each side of the machine with a recess therein so that the stub shaft fits in a kind of socket. The frame of the machine has side walls or members 44 which have shafts 46, one on each side and possibly best shown in FIG. 5, for reception of the mounting forks 36 shown in FIG. 4. The mountings between the debris hopper and the frame of the machine are located on each side of the center of mass of the hopper so that the hopper tends to be cradled or stabilized in its operative position on the machine but will rock some about the stub shafts 40 to allow large debris, such as bottles and cans, to pass under the rear edge of the hopper to be propelled forward by the brush into the debris hopper.

Figure 3:
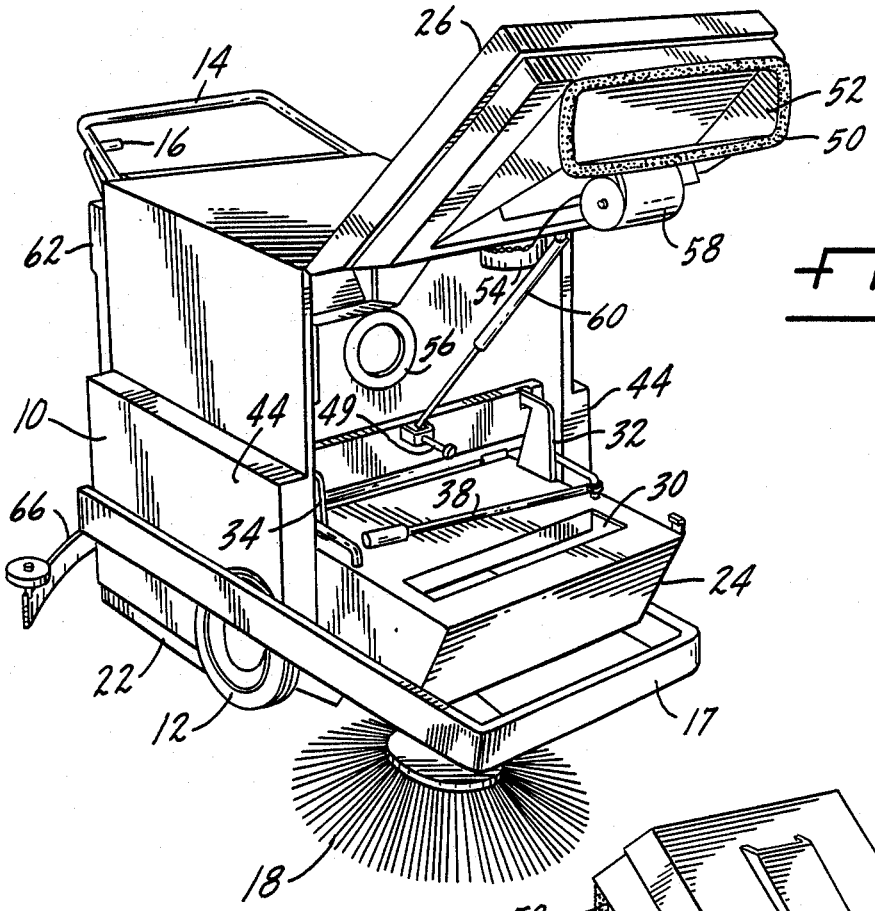
FIG. 3 is a perspective of the unit with the filter housing pivoted up so that the debris hopper may be removed.

The filter assembly 26 is pivoted along its upper edge, as at 48, on the frame of the machine with a stop mechanism 49 which determines the down position of the filter assembly so that a certain amount of preload is applied to a donut type seal 50 mounted around the intake 52 which fits over the opening 30 in the top of the debris hopper to provide a generally airtight seal. A filter panel or filter unit, not shown, is supported in the filter housing 26 such that air passing through the housing passes through the filter unit. The filter housing has an outlet 54 which, when the filter assembly is in its down position, engages a rubber boot 56 or the like but will freely disengage when the filter housing is raised to the FIG. 3 position. The housing or frame of the machine may have a vacuum fan, not shown, which connects to the rubber boot so that air is drawn through the filter unit and debris hopper when the filter assembly is lowered. An extendible flexible tube also may be used in place of the outlet 54 and boot 56. The filter housing may have an electric motor and eccentric weight vibrator 58 attached to the lower surface thereof as shown in FIG. 3 so that it, when operated, vibrates the entire filter housing 26 which causes dirt and dust to fall off of the filter element and to slide through the opening 52 into the debris hopper at opening 30. The vibrator may be operated periodically by the operator. The filter assembly may be counterbalanced by a spring or gas cylinder arrangement 60 that it may be easily raised. Or the filter assembly itself may be light enough so that it can be raised by hand and a suitable brace may be provided to hold it up, like an automobile hood.

A recovery tank 62 is mounted on the rear of the unit underneath the control and steering bar. In certain installations or under certain conditions, it may be desirable that the recovery tank be permanently mounted as explained hereinafter. And for certain installations and situations, it may be desirable that the recovery tank be mounted so that it may be more easily removed for replacement by a wand assembly as explained later.

Figure 8:
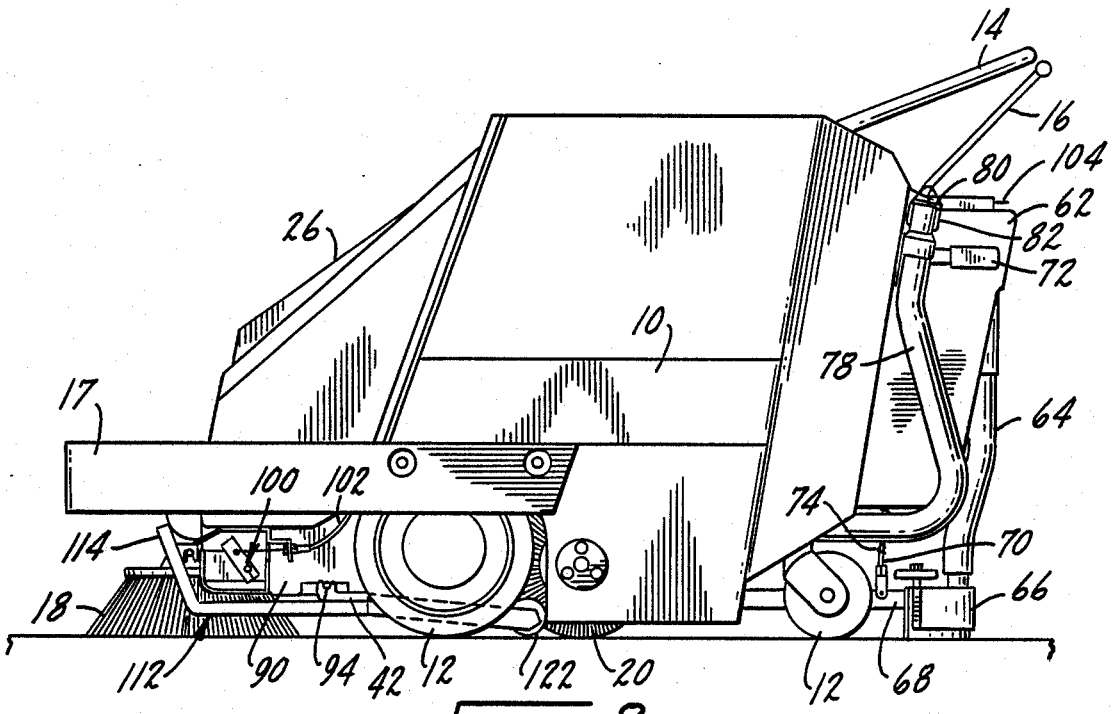
FIG. 8 is a left side view of FIG. 7.
Figure 9:
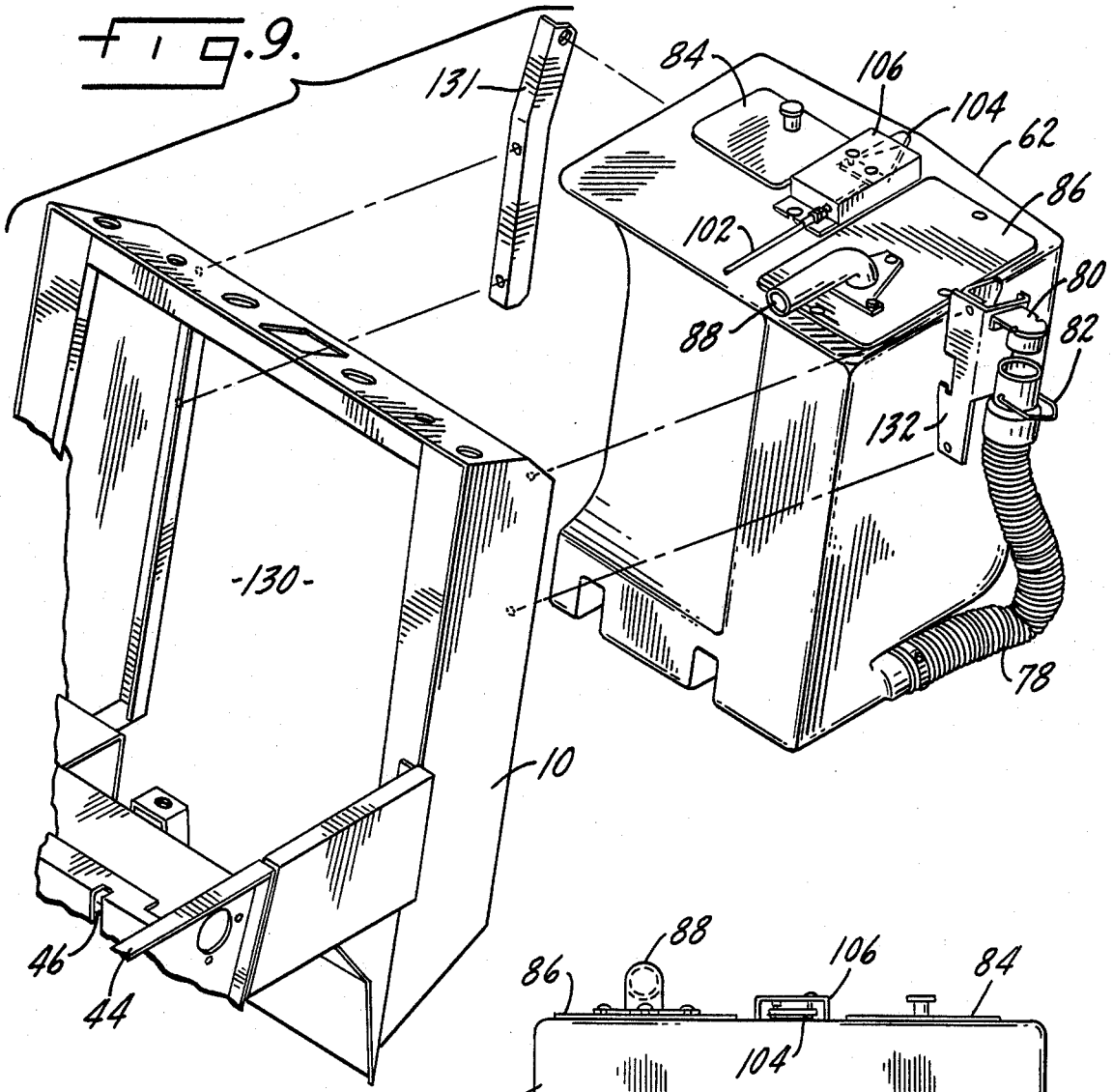
FIG. 9 is a left side perspective, on an enlarged scale and partially exploded, of the recovery tank and the rear of the machine.
Figure 10:
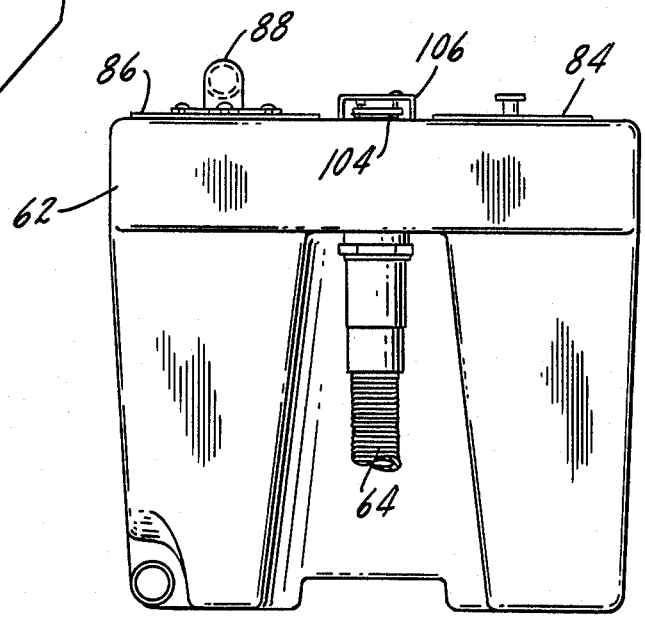
FIG. 10 is a rear view of the recovery tank.

The recovery tank is for use when the unit is converted as explained hereinafter so that it may operate in a scrubbing mode. In this mode of operation, the debris hopper 24 is removed from the front of the unit as shown in FIG. 4 and is replaced by a clean solution tank as explained hereinafter in connection with FIG. 5. The recovery tank 62, as shown in FIGS. 2 and 9, is connected by a hose or tube 64 to a squeegee assembly 66 which is carried on the rear of the machine by a linkage arrangement 68 so that the squeegee may be lowered when the unit is operating in its scrubbing mode and raised when the unit is either transporting or operating in its sweeping mode. The squeegee assembly is connected by a rod or linkage 70 of any suitable type to a manually operable handle 72 at or close to the control station so that the operator may manually raise and lower the squeegee. The rod has a spring arrangement 74 so that the operator may apply down pressure on the squeegee over and above the pressure applied by its weight with spring bias for better floor wiping if desired. A vacuum is applied to the recovery tank by the vacuum fan, which in turn is communicated through the tube 64 to the squeegee 66 to recover dirty solution from the floor or surface being cleaned. The tank also has a tube or hose 78 connected to the bottom of the recovery tank, shown in FIGS. 1, 8 and 9, and held to bracket 80 by a releasable wire bail 82 attached to the end of the hose. When the recovery tank is to be drained, the operator may release bail 82, remove the hose 78 from its bracket 80 and let the tank drain into a sewer or floor drain. During operation the bracket 80 prevents vacuum from being lost in the recovery tank. The recovery tank may have a clean out door 84, best shown in FIG. 9, and a removable defoaming baffle assembly 86 with a suitable shutoff high water float control so that water doesn't get into the vacuum fan, etc., all of which may be conventional. The top of the defoaming unit may have a tubular elbow 88 which may be connected by a flexible hose, not shown, to the vacuum fan when the unit is operating in its scrubbing mode. When the unit is operating in its sweeping mode, the flexible hose may be slipped off of the tube 88 or otherwise disconnected or blocked, as explained hereinafter.

Figure 5:
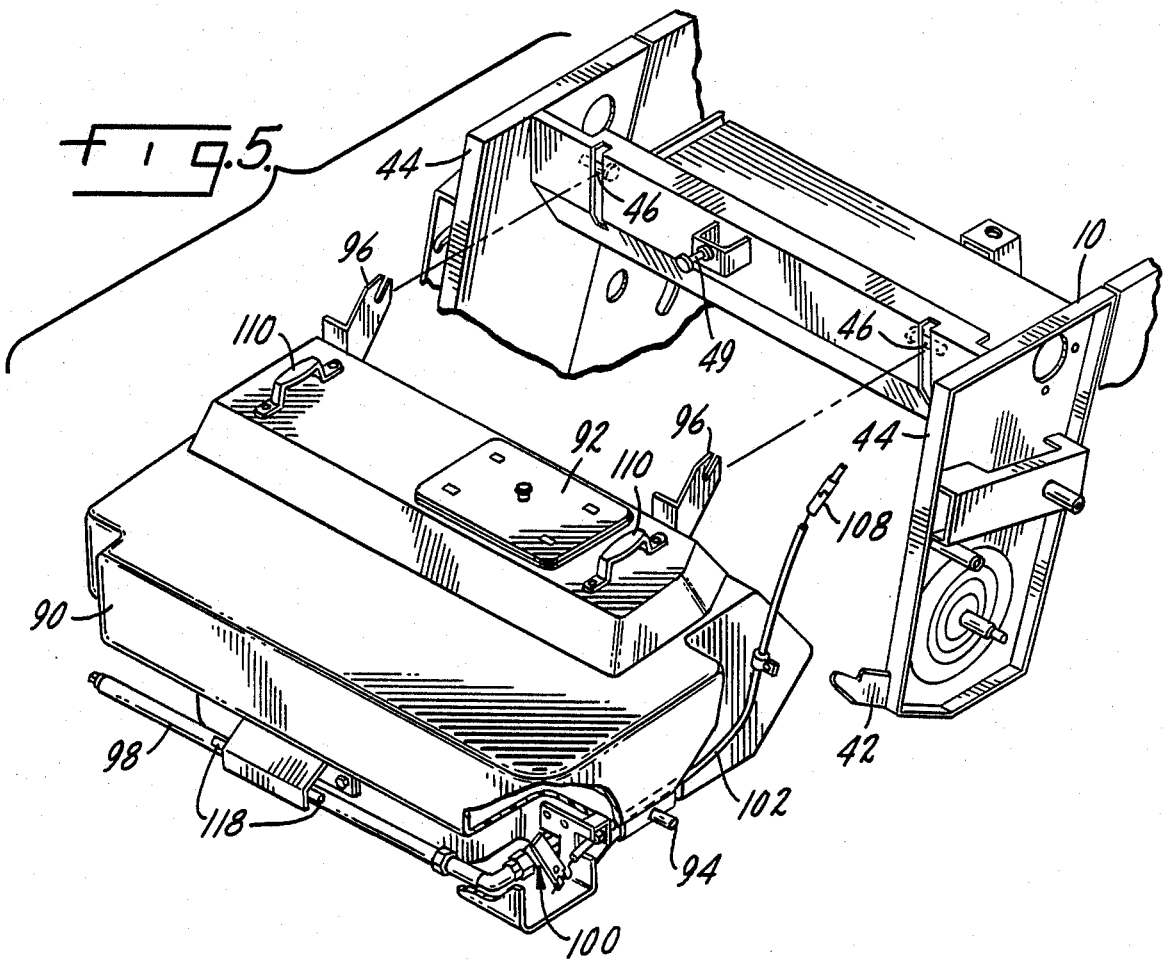
FIG. 5 is an exploded front perspective, similar to FIG. 4, showing the recovery tank being mounted in the front of the machine in place of the debris hopper.

A clean solution tank 90 is shown in FIG. 5 with a top opening covered by a plate 92 through which clean solution may be supplied. A soap strainer, not shown, may first be inserted through the opening so that it extends down into the tank. When filling the tank with whatever detergent or cleaning agent is being used, it may be first put in the strainer and then water may be run through it so as to dissolve the detergent into the tank, all of which may be conventional. The tank or container has trunions 94 on each side, only one being shown in FIG. 5, which fit in the brackets 42 on the front of the machine frame. As well, brackets 96 with slots therein are mounted and extend from the top rear of the solution tank so that they fit over the upper pins or trunions 46 on the frame of the machine. As in the case of the debris hopper, the center of gravity of the solution tank, either full or empty, is between the two mountings so that the tank is stably mounted or suspended or positioned between the two mountings.

The solution tank has a manifold or pipe 98 mounted in a suitable position across the front thereof. The pipe or manifold may have a series of longitudinally disposed holes in the bottom or lower edge or surface so that clean solution from the tank supplied through a lever controlled valve 100 which is controlled by the operator through a Bowden wire 102 may be supplied to the surface. The Bowden wire extends through the frame of the machine to a lever control 104, see FIG. 9, which may be located under a guard 106 on top of the recovery tank or at the control station. The Bowden wire should have a quick disconnect 108, a conventional device, which preferably should be in the form of a disconnect that does not require a tool to either connect or disconnect it and does not require readjustment of the flow control valve when reconnected. The tank may have suitable handles, shown at 110, in FIG. 5, so that the tank may be lifted by the operator either into or out of the front operating position on the frame of the machine.

Figure 6:
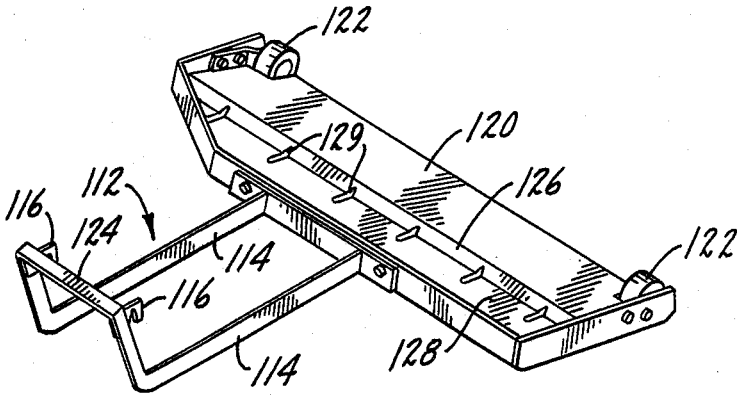
FIG. 6 is a perspective of the debris tray that fits under the solution tank in FIG. 5.

A debris tray 112 shown in FIG. 6 may be mounted under the clean solution tank and has forwardly projecting arms or brackets 114 which have suitably disposed hooks 116 thereon which mount over trunions or stub shafts 118 suitably mounted on the front of the clean solution tank. The debris tray will be under the clean solution tank, as best shown in FIG. 8, and the rear edge 120 of the tray will be generally opposite the main cylindrical brush 20 so that it corresponds in location to the sweeping lip of the debris hopper. The debris tray is supported by two wheels 122 which roll on the floor or surface to be cleaned and their height may be adjustable for accurate setting. The hooks 116 in a sense position and locate the tray under the solution tank in respect to the main brush. To remove the tray, the forward part or crosspiece 124 may be grasped by the operator, lifted up slightly to release the hooks 116 from the pins or trunions 118 and pulled forward. The tray will roll out on its wheels 122. The tray itself has a ridge 126 so that the debris will stay in what may be considered a forward sump 128 and any water or solution is allowed to drain back through a series of openings or slots 129 onto the floor for reuse and eventual pick-up by the squeegee.

Figure 7:
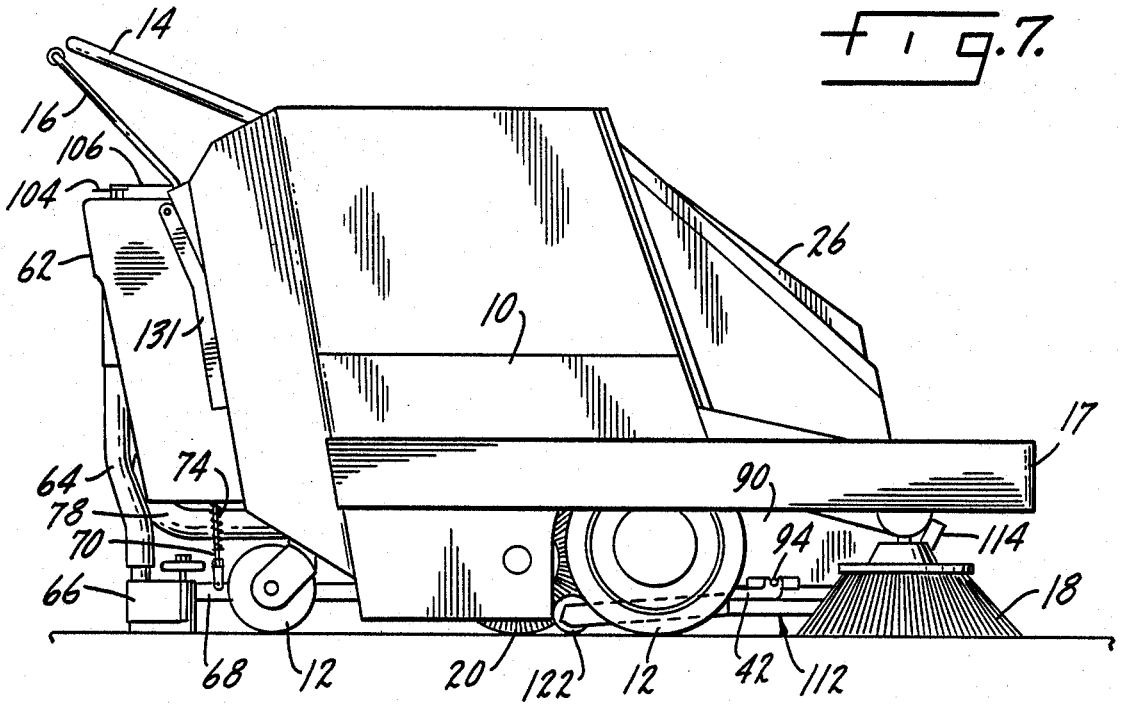
FIG. 7 is a right side view of the machine with all parts assembled for its scrubbing mode.

In FIGS. 7 and 8, the machine is shown converted to a scrubber with the solution tank 90 mounted in front, the debris tray 112 under it and the rear squeegee lowered and in contact with the surface to be cleaned. It will be understood that the brush 20 is preferably of a type that will operate in either the sweeping or scrubbing mode. The same is true of the side brush 18. But they might also be changed to special brushes for each purpose.

The rear of the machine frame 10 may have an opening 130 so that the forward part of the recovery tank more or less sockets into the frame, as shown in FIG. 9, with brackets 131 and 132 mounting or connecting the recovery tank to the machine frame.

Figure 11:
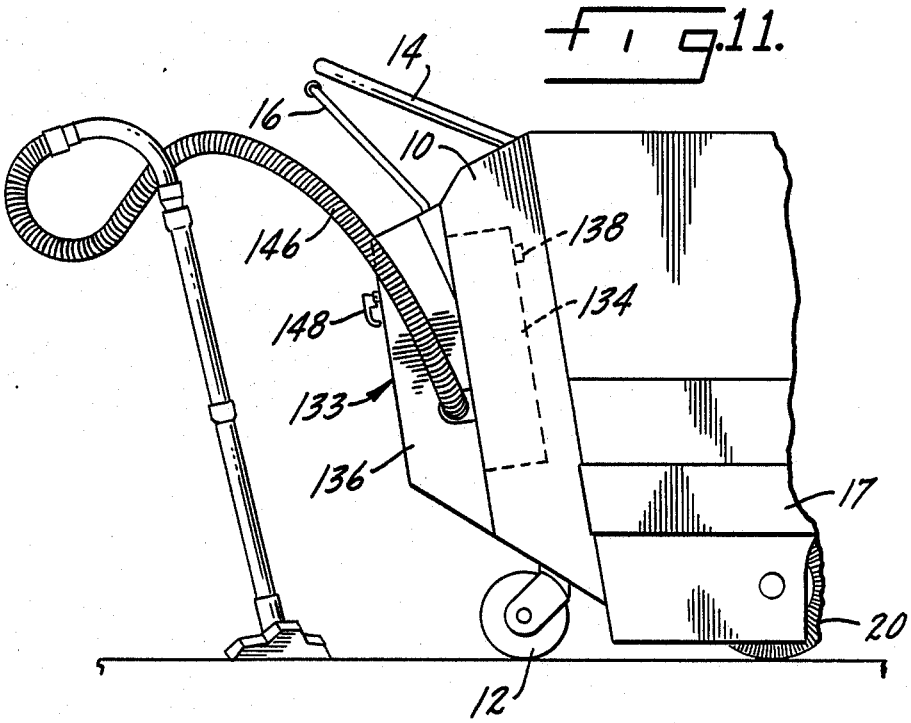
FIG. 11 is a partial right side view, similar to FIG. 7, with a vacuum wand box on the rear of the machine substituted for the recovery tank.
Figure 12:
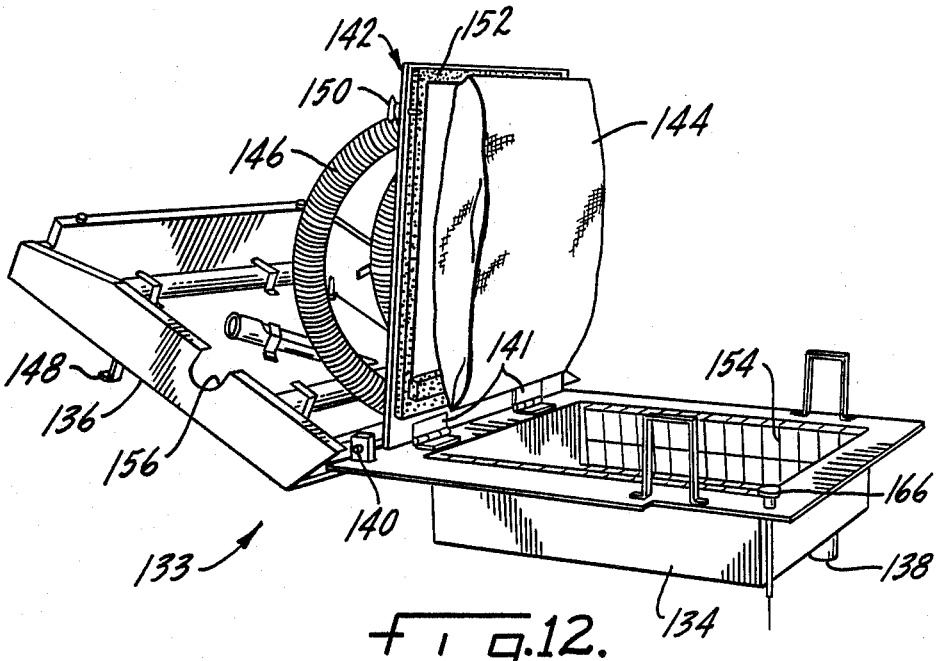
FIG. 12 is a perspective of the vacuum wand box open with various parts and compartments shown.

In FIGS. 11 and 12, a further variant has been shown in which the recovery tank 62 on the rear of the machine has been removed and replaced by a vacuum wand assembly 133 as shown in FIG. 11. It may have forward and rear compartments 134 and 136 as shown in FIG. 12. When the unit is to be operated in its sweeping mode with the debris hopper on the front, the dirty solution or recovery tank 62 on the rear may be removed and replaced by the vacuum wand assembly 133. The front chamber 134 is sealed and may be connected to the vacuum fan through a stub or opening 138. The flexible hose that is normally connected to the elbow 88 to apply a vacuum to the recovery tank and squeegee may be fitted over or connected to the stub tube 138 so that the vacuum from the vacuum system will be applied to the inside of chamber 134. As shown in FIG. 12, the various parts of chambers 134 and 136 may be pivoted along the lower edge thereof as at 140 so that an intermediate divider wall 142 pivoted at 141 on chamber 134 may be provided which is sealed to the rear chamber 134 so that the vacuum communicated to the interior thereof through connection 138 is applied to the outside of a porous filter bag 144 of a suitable type. The inside of the filter bag is communicated through a short tube, not shown, passing through intermediate wall 142 which in turn is connected to a vacuum wand 146 which may be stowed in chamber 136. Handles 148 may release a suitable lock mechanism so that the outer housing 136 pivoted at 140 may be pivoted down to the position shown more or less in FIG. 12 which will expose all of the vacuum wand and its accessories which may be mounted in chamber 136 in any suitable fashion as shown in FIG. 12 so that they may be readily selected and used by the operator. The intermediate door 142 may have screws or suitable connectors 150 which enable the intermediate door to be pulled tight against the rear of the forward chamber 134 so that suitable sealing or gasketing 152 will create an airtight chamber in the forward compartment. The forward compartment 134 may have a suitable mesh or cage 154 which suspends the filter bag 144 so that most or all of it can pass air and blinding of any part of the filter medium 144 is prevented. The housing 136 may have a suitable notch or opening 156 in which the wand or hose may be placed after it is assembled and the housing closed, as shown in FIG. 11.

In FIG. 13, several of the components or parts are shown diagrammatically to illustrate the arrangement when the machine is powered by a gasoline engine. A vacuum fan 158 may be connected to the filter housing 26, in FIG. 3, to provide the necessary vacuum for the sweeping mode when the debris hopper is in place, as shown in FIGS. 3 and 4. The intake 160 in FIG. 13 for the vacuum fan may be considered to be the same as or connected to the intake 56 in FIG. 3 with any suitable exhaust 162 to the atmosphere. The intake to the vacuum fan is also connected by a suitable hose 163 or the like which removably fits on the elbow 88 in FIG. 9 on the recovery tank. The vacuum fan 158 may be belt driven as at 161 from a suitable gasoline engine or the like on the machine and a damper or butterfly valve 164 is installed in the vacuum fan inlet which is manually controlled by the operator through a suitable Bowden wire connection and knob 166 on the vacuum wand assembly, as shown in FIG. 12, if a unit is to be supplied or operated with a vacuum wand kit. If not, the damper 164 in the vacuum fan inlet would not be necessary.

When the unit is to be operated in a sweeping mode with a vacuum wand assembly in use, the damper 164 is open for sweeping and closed when the vacuum wand is used which supplies full vacuum to the vacuum wand. At the same time, the hose 163 would be slipped off of the elbow 88 and connected to the tube or connection 138 in FIG. 11 for the vacuum wand assembly.

In the sweeping mode, air enters the fan from both the filter compartment and the recovery tank. The hose 163 is sized so that there is still adequate airflow through the filter for sweeping dust control and, at the same time, the filer is not required to pass excessive air which would suck in more dust and load up the filter quickly. In the scrubbing mode, the filter compartment sets down on top of the solution tank 90, as shown in FIGS. 7 and 8, which blocks the airflow through the filter to the fan. Thus the fan gets its entire air supply through hose 163 which allows adequate air to flow for the water pick-up with the squeegee. The switchover of airflow from sweeping mode to scrubbing mode is thus entirely automatic with no attention required from the operator.

When the vacuum wand is installed, it is necessary to close off the airflow from the filter to the fan when the wand is in use. The damper 164 for the fan inlet is included with the vacuum wand assembly.

FIGS. 14 and 15 are for a battery operated unit where the fan and other components are driven by electric motors. In FIG. 14, the vacuum fan 158 has its inlet 160 connected to the filter assembly as before. And a damper, as at 164 in FIG. 13, is not necessary. The fan is driven by an electric motor 159 which also drives the main brush and the traction. The pulley ratios are such that the fan turns slower than in the gasoline engine version supplying only sufficient airflow for sweeper dust control. In the scrubbing mode, the filter compartment again sits on top of the solution tank which blocks the air inlet to the fan. The fan is still belted to the motor and still turns but consumes only negligible power since it is pumping no air.

A second fan 168, as shown in FIG. 15, has an intake tube 170 mounted on the elbow 88 on the recovery tank. The fan 168 may be motor driven, as at 169, and exhausts to the atmosphere. This fan supplies sufficient vacuum to the recovery tank for squeegee operation and it may be controlled by suitable switches on the dashboard of the unit. When the vacuum wand is installed in place of a recovery tank, hose 170 is connected to the tube or connection 138 in FIGS. 11 and 12 so that the vacuum is supplied to the wand assembly with the fan motor being switch controlled from the dashboard.

The use, operation and function of the invention are as follows:

The unit is in the nature of a walk-behind combination sweeper and scrubber although many of the aspects and features may be used in other types of machines.

As a combination sweeper and scrubber, the unit has the advantage that the recovery tank for the scrubbing mode may be always or permanently mounted on the machine and is separate from the clean solution tank which is removably mounted on the front of the machine. The result is that the clean solution tank is small enough that it can be physically handled by the operator and does not require any dollies or bulky extra equipment to get it on and off the machine. When operating in the sweeping mode, the debris hopper will be mounted in the forward part of the machine and the recovery tank will remain in place on the rear but will not be in use. By way of comparison, the filter unit 26 on the front is used when the unit is operating in its sweeping mode but is not functioning when the unit has been converted to a scrubber. As shown in FIG. 3, the filter assembly may be raised and either the debris hopper or clean solution tank mounted on the front of the machine. With the debris hopper in place, the filter unit will be pivoted down and its weight will be such that the seal 52 will be preloaded to the proper extent against the top of the hopper around opening 30 with the preload being such that the hopper will rock to allow large obstacles or debris to go under it. If the clean solution tank is mounted in the forward part of the machine, the filter assembly will again be pivoted down but will merely rest on top of the clean solution tank and air will not be drawn through the filter unit. Since the filter unit entrance is blocked, vacuum is not supplied through the port 56 and tube 54. During the sweeping mode, the recovery tank may be left on the rear of the machine as it will not interfere with the operation in the sweeping mode.

The rear squeegee may also be left permanently attached. It may be lifted when the machine is in its sweeping mode and may be lowered into contact with the floor when in the scrubbing mode.

During the sweeping mode, the clean solution tank and debris tray, shown in FIGS. 6, 7 and 8, will be removed from the machine and stored or set aside. The advantage of having a single tank on the front is that it is light enough that one man can lift it in and out without a dolly and the changeover time will be quite short, for example, something on the order of two minutes. During the scrubbing mode, all of the available vacuum is delivered to the recovery tank and rear squeegee which results in excellent water pick-up.

If desired, the main brush and side brush may be replaced with special scrubbing brushes or combination sweeping/scrubbing brushes may be used on either one or both. The squeegee itself may be preloaded when in its down position by either a flat or coiled spring or the like so that whatever force is necessary, in addition to its own weight, is provided to make sure that the floor is wiped dry.

Where the unit is powered by an internal combustion engine, a belt driven fan to create the vacuum would turn fast enough to provide adequate squeegee lift in the scrubbing mode and more than enough dust control in the sweeping mode. If the unit is to be a battery powered electric version, the belt driven fan creating the vacuum will probably run slower to reduce battery drain and normally will provide only enough air for dust control in the sweeping mode. And a second fan could be provided, either a two or three stage unit, with a high suction capability and an integral electric motor which may be mounted under the filter unit on the machine and ducted to the recovery tank. It may only be used in the scrubbing mode and with vacuum wand.

The invention is in the nature of a system or assemblage which will enable the user to operate the machine as a sweeper or a scrubber. The interchangeability of the debris hopper and solution tank in the front along with either a permanently mounted or a removably mounted recovery tank in the rear which can be interchanged with a wand assembly housing provides great versatility.

A full wrap around bumper protects the front of the machine but still allows for dumping or removing the debris hopper and inserting or removing the solution tank and debris tray.

While the preferred form and several variations of the invention have been shown and described, it should be understood that additional modifications, changes, substitutions and alterations may be made without departing from the invention's fundamental theme.

We claim:

1. In a convertible sweeping and scrubbing unit operable in either a sweeping mode or a scrubbing mode, a mobile frame, a cylindrical brush on the frame for removing soilage or propelling debris from a surface to be cleaned, a removably mounted hopper in a forward location on the frame ahead of the brush with an opening therein for receiving and collecting debris propelled by the brush, a vacuum system and filter on the frame for drawing a vacuum through the debris hopper to reduce dusting, means for removably mounting the debris hopper on the frame, a clean solution tank constructed to be mounted in the forward location on the frame when the debris hopper has been removed for converting the sweeper into a scrubber, means for supplying solution from the clean solution tank to the surface to be cleaned at a location ahead of the brush, a recovery tank and squeegee fixed on the rear of the frame for picking up dirty solution when the unit is operating as a scrubber, means for connecting the vacuum system to the recovery tank when the unit is being operated as a scrubber to pick up dirty solution by the squeegee and bring the dirty solution to the recovery tank, and means for raising the squeegee out of contact with the surface when the unit is operating as a sweeper.

2. The structure of claim 1 further characterized by and including a debris tray mounted in front of the brush to receive debris propelled forward by the brush when the unit is operating in the scrubbing mode.

3. The structure of claim 2 further characterized by and including openings in the debris tray to allow solution to drain back on to the surface.

4. The structure of claim 3 further characterized in that the debris tray is separate from the clean solution tank.

5. The structure of claim 2 further characterized by and including rollers on the rear of the debris tray for supporting the weight of the tray on the surface during operation, and a connection between the forward part of the tray and the clean solution tank.

6. The structure of claim 1 further characterized by and including a vacuum wand assembly interchangeable with the recovery tank for connection to the vacuum system usable when the unit is to be operated as a sweeper.

7. The structure of claim 1 further characterized in that the mounting of the clean solution tank on the frame automatically blocks the inlet to the vacuum system.

8. In a surface sweeping and scrubbing modular machine system usable in either a sweeping mode or a scrubbing mode of operation, a mobile frame, a cylindrical brush on the frame for removing soilage or propelling material forwardly from a surface to be cleaned, a squeegee on the rear of the frame constructed and arranged to be raised and lowered so that it is usable during the scrubbing mode and may be raised out of contact with the surface being cleaned during the sweeping mode, a vacuum system on the frame adapted to create an air current through the hopper to minimize dusting during the sweeping mode, mounting locations on both the front and rear of the frame, a debris hopper removably mountable at the front mounting location for receiving debris swept forward by the brush when the machine is operating in the sweeping mode, a solution tank removably mountable at the front mounting location when the debris hopper is removed for supplying cleaning solution to the surface to be cleaned when the machine is operating in the scrubbing mode, a recovery tank removably mountable on the rear mounting location and connectable to the squeegee and vacuum system to collect and hold dirty solution from the surface when the machine is operating in the scrubbing mode, and a vacuum wand assembly removably mountable on the rear mounting location when the recovery tank is removed while the machine is operating in the sweeping mode and connectable to the vacuum system for collecting debris outside of the machine's normal path of travel.

9. The system of claim 8 further characterized by and including a connection for the vacuum system alternately connectable to draw air through the debris chamber during the sweeping mode and through the recovery tank and squeegee during the scrubbing mode.

10. A method of operating a surface cleaning machine in either a sweeping mode or a scrubbing mode for either sweeping or scrubbing a surface to be cleaned, the machine having a mobile frame, a rotatably mounted brush on the frame with a clean solution tank, a recovery solution tank, a pick-up squeegee for dirty solution, a vacuum system for preventing dusting during the sweeping mode and for picking up dirty solution from the floor by the squeegee during the scrubbing mode, and a hopper for receiving debris, including the steps of fixing the recovery tank on the rear of the frame when the unit is operating in either mode, interchangeably mounting the clean solution tank and the debris hopper on the front of the frame in operative position opposite the brush, the clean solution tank during the scrubbing mode and the debris hopper during the sweeping mode, alternately connecting the vacuum system to either the debris hopper to prevent dusting during the sweeping mode or to the recovery tank to draw dirty solution from the floor by the squeegee to the recovery tank during the scrubbing mode, and raising the squeegee out of contact with the surface when the unit is operating in the sweeping mode.

11. The method of claim 10 further characterized in that the unit further includes a vacuum wand assembly, and further including the step of replacing the recovery tank with the vacuum wand assembly and connecting the vacuum wand assembly to the vacuum system when the unit is to be operated in the sweeping mode so that debris may be collected by the vacuum wand outside of the machine's normal path of travel.

12. In a convertible sweeping and scrubbing machine, a mobile frame, a cylindrical brush on the frame for removing soilage or for propelling debris from a surface to be cleaned, a debris hopper in a forward mounting location on the frame ahead of the brush with an opening therein associated with the brush for receiving and collecting debris propelled by the brush, a movably mounted filter housing on the frame above the debris hopper constructed and arranged to be moved between an operative position where the filter housing engages the hopper and an inoperative position where the filter housing is remote from the hopper, openings in the filter housing and debris hopper which are aligned when the filter housing and debris hopper are in their operative position, a vacuum system on the frame adapted to create an air current through the filter housing, the debris hopper, and the aligned openings to reduce dusting around the cylindrical brush, a seal around the aligned openings between the debris hopper and filter housing, means for removably mounting the debris hopper so that the debris hopper may be removed from the frame, a clean solution tank constructed and arranged to be mounted in the forward mounting location on the frame to take the place of the debris hopper when the debris hopper has been removed for converting the sweeper into a scrubber, means for supplying solution from the clean solution tank to the surface to be cleaned at a location ahead of the brush, a recovery tank and squeegee on the frame behind the brush for picking up dirty solution when the machine is being operated as a scrubber, means for communicating the vacuum system to the recovery tank so that dirty solution will be picked up by the squeegee and brought to the recovery tank when the machine is being operated as a scrubber, and a surface on the clean solution tank engaged by and effective to at least substantially close the opening in the filter housing when the clean solution tank is mounted in the forward location on the frame so that substantially the full vacuum of the vacuum system will automatically be applied to the recovery tank and squeegee when the clean solution tank is mounted in the forward location and the machine is being operated as a scrubber.

13. The structure of claim 12 further characterized in that the vacuum system is operated by an internal combustion engine on the frame of the machine.

14. The structure of claim 12 further characterized by and including two electrically driven vacuum fans on the frame of the machine, one for operating the dust control system and the other one for creating a vacuum for the recovery tank and wand.

15. In a convertible sweeping and scrubbing machine, a mobile frame, a cylindrical brush on the frame for removing soilage or for propelling debris from a surface to be cleaned, a debris hopper in a forward location on the frame ahead of the brush with an opening therein associated with the brush for receiving and collecting debris propelled by the brush, a filter housing on the frame, a vacuum system on the frame adapted to create an air current through the filter housing and debris hopper to reduce dusting around the cylindrical brush, means for removably mounting the debris hopper so that the debris hopper may be removed from the frame, a clean solution tank constructed and arranged to be mounted in the forward location on the frame to take the place of the debris hopper when the debris hopper has been removed for converting the sweeper into a scrubber, means for supplying solution from the clean solution tank o the surface to be cleaned at a location ahead of the brush, a squeegee and a removably mounted recovery tank on the frame behind the brush for picking up dirty solution when the machine is being operated as a scrubber, means for communicating substantially the full vacuum of the vacuum system to the recovery tank when the machine is being operated as a scrubber so that dirty solution will be picked up by the squeegee and brought to that recovery tank, a vacuum wand assembly removably mountable in the rear mounting location in place of the recovery tank when the recovery tank is removed while the machine is operating as a sweeper and connectable to the vacuum system for collecting debris outside of the machine's normal path of travel, and means for selectively communicating substantially the full vacuum of the vacuum system to the vacuum wand assembly when the vacuum wand assembly is mounted on the frame in place of the recovery tank.

16. The structure of claim 15 further characterized in that the vacuum system is operated by an internal combustion engine mounted on the frame of the machine.

17. The structure of claim 15 further characterized by and including two electrically driven vacuum fans, one for operating the dust control system and the other for providing a vacuum for the recovery tank and wand, mounted on the frame of the machine.

18. In a sweeping machine, a mobile frame, a cylindrical brush on the frame for propelling debris from a surface to be cleaned, a debris hopper on the frame with an opening therein associated with the brush for receiving and collecting debris propelled by the brush, a filter housing and a vacuum system on the frame associated with the debris hopper to reduce dusting around the cylindrical brush, an internal combustion engine on the frame for operating the vacuum system and propelling the machine, a vacuum wand assembly on the frame to collect debris outside of the machine's normal path of travel, a connection between the vacuum wand assembly and the vacuum system, and an operator controlled valve in the inlet to the vacuum system for communicating substantially all of the vacuum of the vacuum system to the vacuum wand assembly at the discretion of the operator.

19. In a combination sweeping and scrubbing machine, a mobile frame, a rotatably mounted cylindrical brush on the frame for removing soilage or for propelling debris from a surface to be cleaned, a debris hopper on the frame with an opening therein for receiving debris propelled by the brush when the machine is operating as a sweeper, a filter and vacuum on the frame for reducing dusting around the cylindrical brush, means for removably mounting the debris hopper on the frame, a clean solution tank adapted to be mounted in place of the debris hopper when the debris hopper is removed to convert the machine to a scrubbing machine, a recovery tank and a squeegee on the frame for picking up dirty solution when the machine is being used as a scrubber, a connection between the vacuum system and the recovery tank for communicating vacuum from the vacuum system to the recovery tank and squeegee, and means for communicating substantially all, of the vacuum from the vacuum system through the connection to the recovery tank and squeegee when the machine is being operated as a scrubber.

20. The structure of claim 19 further characterized in that the filter engages the top of the clean solution tank which blocks air flow through the filter thereby causing substantially all of the vacuum to be communicated through the connection to the recovery tank and squeegee.

21. The structure of claim 19 further characterized by and including a butterfly valve in the intake to the vacuum system which, when operated, blocks the intake so that substantially all of the vacuum of the vacuum system is communicated through the connection to the recovery tank and squeegee.

22. The structure of claim 19 further characterized in that the connection between the vacuum system and recovery tank is open at all times the connection being of a sufficiently small size such that the connection does not significantly detract from the effectiveness of the vacuum system's ability to reduce dusting around the cylindrical brush when the machine is being operated as a sweeper.

23. In a combination sweeping and scrubbing machine, a mobile frame, a rotatably mounted cylindrical brush on the frame for removing soilage and for propelling debris from a surface to be cleaned, a debris hopper on the frame with an opening therein for receiving debris propelled by the brush when the machine is operated as a sweeper, a filter and vacuum system on the frame for reducing dusting around the cylindrical brush, means for removably mounting the debris hopper on the frame, a clean solution tank adapted to be mounted in place of the debris hopper when the debris hopper is removed to convert the machine to a scrubber, a recovery tank and squeegee on the frame for picking up dirty solution when the machine is being operated as a scrubber, and a connection between the vacuum system and the recovery tank for communicating vacuum from the vacuum system through the recovery tank and squeegee, the clean solution tank and the debris hopper being sized such that said tank and debris hopper may be manually handled by an operator without auxiliary mechanical lift equipment.

* * * * *